US006935088B1

(12) United States Patent
Lin

(10) Patent No.: US 6,935,088 B1
(45) Date of Patent: Aug. 30, 2005

(54) METHOD OF PACKAGING STONE CELL PLATE

(75) Inventor: Zhi-Long Lin, Fujian (CN)

(73) Assignee: Xiamen Great Stone Inc., Fujian (CN)

( * ) Notice: Subject to any disclaimer, the term of this patent is extended or adjusted under 35 U.S.C. 154(b) by 0 days.

(21) Appl. No.: 10/809,745

(22) Filed: Mar. 25, 2004

(51) Int. Cl.[7] ..... B65B 61/20
(52) U.S. Cl. ..... 53/445; 53/435; 53/474; 53/461
(58) Field of Search ..... 53/445, 474, 461, 53/435, 438, 447, 449, 458, 168, 171

(56) References Cited

U.S. PATENT DOCUMENTS 3,708,946 A * 1/1973 Cahill ..... 53/472
3,883,990 A * 5/1975 Stidolph ..... 47/41.01
3,924,354 A * 12/1975 Gregoire ..... 47/41.01
4,053,049 A * 10/1977 Beauvais ..... 206/318
4,110,955 A * 9/1978 Rambold ..... 53/445
4,446,671 A * 5/1984 Stalder ..... 53/445
5,246,121 A * 9/1993 Mitake et al. ..... 211/41.13
5,255,784 A * 10/1993 Weder et al. ..... 206/423
5,417,034 A * 5/1995 Gabler et al. ..... 53/399
5,522,205 A * 6/1996 Weder ..... 53/475
5,644,898 A * 7/1997 Shepherd et al. ..... 53/445
6,769,230 B2 * 8/2004 Handa et al. ..... 53/461
6,802,174 B2 * 10/2004 Krausz ..... 53/474

* cited by examiner

*Primary Examiner*—Sameh H. Tawfik
(74) *Attorney, Agent, or Firm*—Charles E. Baxley

(57) ABSTRACT

The present invention provides a method of packaging stone cell plate, in which four steps as follows: the first step is to cut the stone plate into a size that the cust omers can lay over directly; the second step is to lay a crash pad on the bottom side of the stone cell plate, in which said crash pad is made of fiber board or expanded material; the third step is to encapsulate the stone cell plate and the crash pad together with plastic film so that the surface of the stone cell plate is covered by the plastic film, and the stone cell plate and the crash pad are tied tightly together. The present invention simplifies the packaging process, and facilitates to operation, and the customers looking at and selecting.

2 Claims, 1 Drawing Sheet

METHOD OF PACKAGING STONE CELL PLATE

BACKGROUND OF THE INVENTION

1. Field of the Invention

The present invention relates to method of packaging stone cell plate, and more particularly to a convenient packaging method with an easily selected packing material.

2. Description of Prior Art

In accordance with the conventional packed stone cell plate market, the stone cell plate is packaged individually with fiber board firstly, and wrapped tightly, thereby preventing the packed stone cell plate from breaking down caused by striking and scratching in transportation, further to affect the quality of the stone cell plate, and for facilitating to select for customers, said fiber board is opened a hole so that the customers can see the color and figure.

In this way, the packaging process need tow steps-wrapping and tying, if loosing in wrapping or tying, the wrapping effect will be directly affected, and the fiber board should be pre-opened a hole before wrapping, as packaging, the fiber board pre-opened the hole should be placed on the decorating surface of the stone cell plate so that the customers can look at it via the hole, so the packaging process is become to complex and complicated in operation. And in selling, only through the opened hole to see the stone cell plate, the effect is limited and indirectly.

OBJECTS AND SUMMARY OF THE INVENTION

It is therefore a main object of the present invention to provide a method of packaging stone cell plate which can simplify the process and facilitate the operation, meanwhile facilitate the customers to look at and select.

For achieving the object mentioned above, the present invention provides a method of packaging stone cell plate including following steps as:

The first step is to cut the stone plate into a size that the customers can lay over directly.

The second step is to lay a crash pad on the bottom side of the stone cell plate, in which said crash pad is made of fiber board or expanded material.

The third step is to encapsulate the stone cell plate and the crash pad together with plastic film so that the surface of the stone cell plate is covered by the plastic film, and the stone cell plate and the crash pad are tied tightly together.

Based on above-mentioned method, the added fourth step is to encase the packaged stone cell plates sequentially overlying into a bigger case for facilitating to transportation.

Utilizing above-mentioned method to packaging the stone cell plate, the stone cell plate can be directly packaged by encapsulating with plastic film, so as to avoid the stone cell plate package loosing of the conventional technology, and eliminate the pro-opening hole on the fiber board, further to simplify the packaging technology and process. Via the transparent plastic film, the customers can see the color and figure of the stone cell plate directly facilitating to select. Additionally, the crash pad laid down can efficiently avoid the stone cell plate breaking down in transportation, and the plastic film also can prevent the surface of the stone cell plate from scratching, therefore, the quality of the stone cell plate is guaranteed, hence the present invention simplifies the process and facilitates the operation and to watch and to be selected by the customers.

DETAILED DESCRIPTION OF PREFERRED EMBODIMENTS

Figure 1:
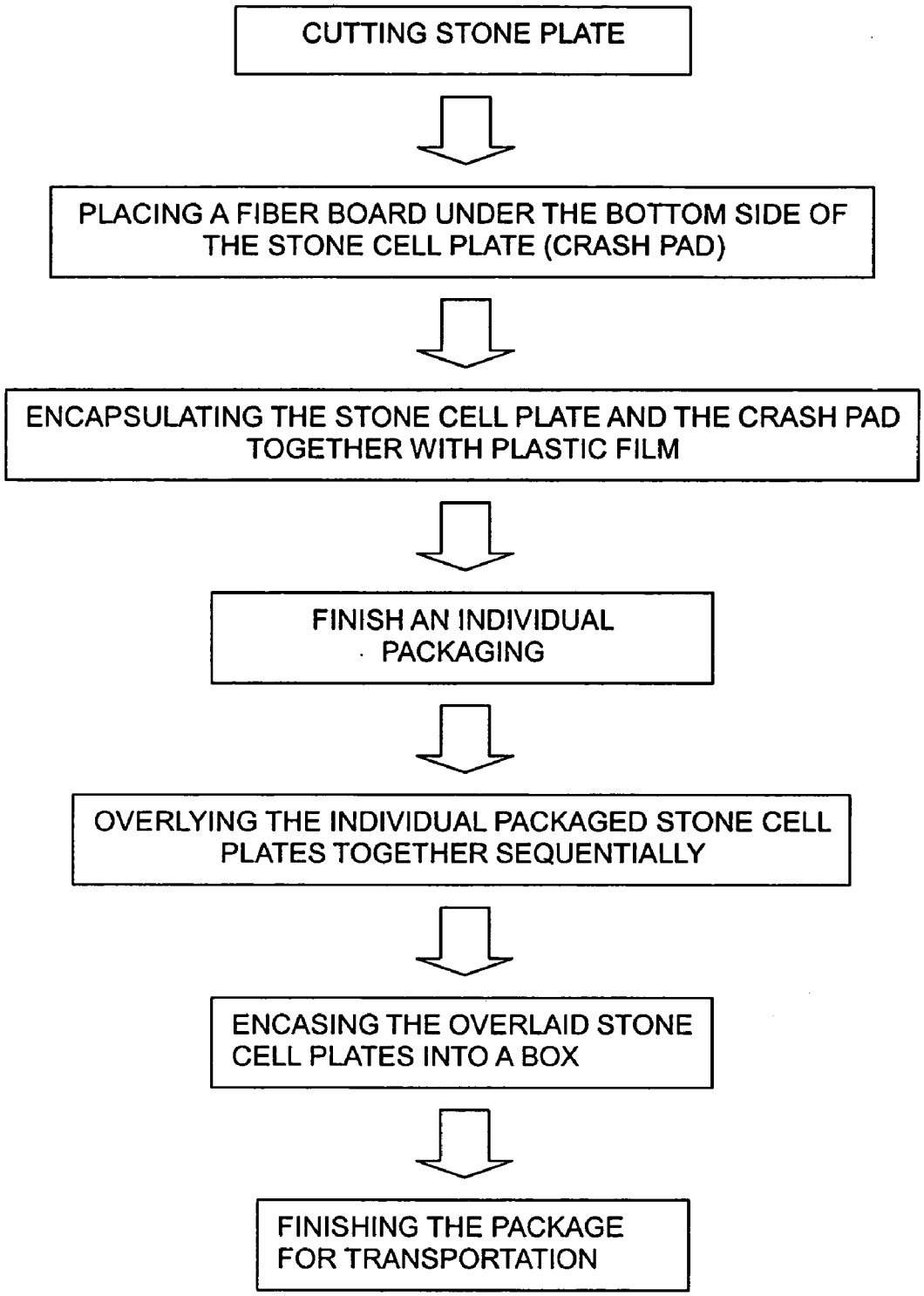
FIG. 1 is a flowchart of the present invention.

Referring to FIG. 1, the preferred embodiment of the present invention is to provide a method, in which firstly the stone plate is cut into the size of stone cell plates so that the customers can use them directly; then, place a crash pad made of fiber board or expanded material and so on, under the bottom side of the stone cell plate; finally, encapsulate the cut stone cell plate and the crash pad together with plastic film so that the surface of the stone cell plate is covered with transparent plastic film, and the stone cell plate and the crash pad are tied tightly together for facilitating to transportation directly.

In this way, by means of encapsulating technology with the plastic film, the present invention is to package the stone cell plate without pre-opening a hole on the fiber board, further to simplify the packaging process, and to avoid the package loosing; and the customers can look at the color and figure of the stone cell plate via the transparent plastic film directly without through a hole opened on the fiber board for facilitating to select.

For facilitating to transportation, based on the above-mentioned method, the packaged stone cell plates can be sequentially overlaid together in one direction just like all the decorating surfaces of the stone cell plates face to the same side so as to sandwich a crash pad between two adjacent stone cell plates, and then encased a certain number of overlaid packaged stone cell plates into a bigger box, just like second case for facilitating to transportation.

I claim:

1. A method of packaging stone cell plate, comprising:

a first step is to cut the stone cell plate into a size that customers can use directly;

a second step is to lay a crash pad on a bottom side of the stone cell plate, in which said crash pad is made of fiber board or expanded material;

a third step is to encapsulate the stone cell plate and the crash pad together with plastic film so that a surface of the stone cell plate is covered by the plastic film, and the stone cell plate and the crash pad are tied tightly together.

2. A method of packaging stone cell plate as claimed in claim 1, wherein added a four step to encase the packaged stone cell plates sequentially overlying into a bigger case for facilitating to transportation.

* * * * *